United States Patent [19]

Arfert et al.

[11] 3,979,012

[45] Sept. 7, 1976

[54] CONTAINER HAVING OPENING MEANS

[75] Inventors: Horst F. W. Arfert; Edward D. Gardner, both of Richmond, Va.

[73] Assignee: Reynolds Metals Company, Richmond, Va.

[22] Filed: Dec. 22, 1975

[21] Appl. No.: 643,527

[52] U.S. Cl. ..... 220/231; 220/260; 220/270; 220/359

[51] Int. Cl.[2] ..... B65D 51/16

[58] Field of Search ..... 220/231, 260, 270, 271, 220/359

[56] References Cited

UNITED STATES PATENTS

| | | | |
|---|---|---|---|
| 3,687,332 | 8/1972 | Westfall et al. | 220/231 |
| 3,717,276 | 2/1973 | Luczak et al. | 220/231 X |

*Primary Examiner*—George T. Hall
*Attorney, Agent, or Firm*—Glenn, Lyne, Gibbs and Clark

[57] ABSTRACT

A container is provided having a deformable metal container body, adapted to contain a product therein and having a bottom wall and a side wall which has a tubular upper portion terminating in a first circumferential bead defining an open end of the container body. A deformable metal closure for the container body is provided and the closure has a main body portion adjoined at its outer edge by an annular flange which has a generally U-shaped cross-sectional configuration defined by a bight with an inner leg portion and an outer leg portion extending from opposite ends of the bight and the inner leg portion adjoins the main body portion and the outer leg portion terminates in a second circumferential bead. An annular indentation is provided in the inner leg portion of the flange and the tubular upper portion beneath the first bead with the annular indentation providing a seal between the closure and container body. The closure has pull tab means provided as a part thereof for permanently deforming at least part of its main body portion within the container body and causing at least a part of the inner leg portion to be pulled away from the tubular upper portion and its adjoining first bead thereby enabling removal of the closure from the container.

10 Claims, 4 Drawing Figures

CONTAINER HAVING OPENING MEANS

CROSS-REFERENCE TO RELATED APPLICATION

This application is related to application Ser. No. 534,721, filed Dec. 20, 1974.

BACKGROUND OF THE INVENTION

Containers made of metal materials, such as thin gauge aluminum alloys, are in use throughout industry for containing products such as food products. For example, puddings, gelatin, desserts, fruits, and the like are often sold in thin gauge metal containers each of which is sized to provide normal servings and each container may then be used as a serving dish whereby the user is encouraged to eat directly therefrom using an appropriate eating utensil or the user is encouraged to drink directly from such container. A problem with many of the thin gauge metal containers in use is that the lid or closure provided on each of these containers is difficult to remove and jagged metal edges are sometimes left on each the container and the closure.

SUMMARY

This invention provides an improved metal container and closure which is comparatively simple to manufacture, to close and to open. Further, the invention provides a metal container and closure which is relatively safe in that neither the closure nor the container have sharp jagged metal edges prior to or after the closure is separated from the container.

Accordingly, it is an object of this invention to provide a container having one or more of the novel features set forth above or hereinafter shown or described.

Other details, features, objects, uses, and advantages of this invention will become apparent from the embodiment thereof presented in the following specification, claims, and drawing.

BRIEF DESCRIPTION OF THE DRAWING

The accompanying drawing shows a present preferred embodiment of this invention, in which.

DESCRIPTION OF ILLUSTRATED EMBODIMENT

Figure 1:
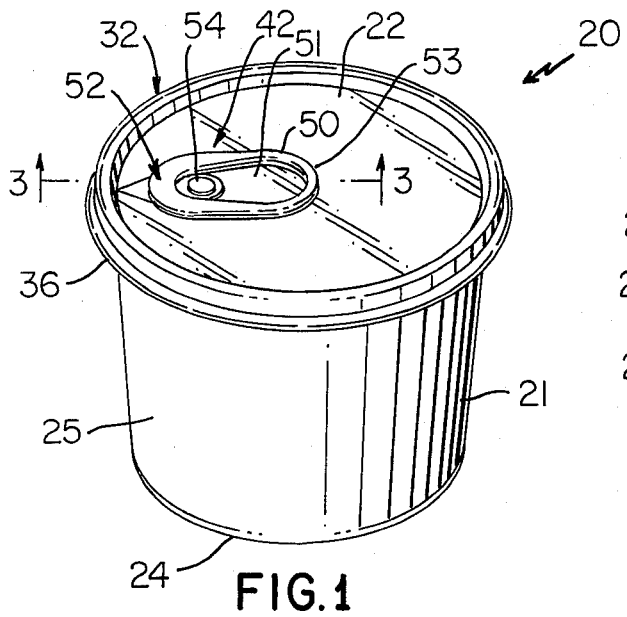
FIG. 1 is a perspective view of the embodiment of a container of this invention which has a closure sealed thereon and which contains a product therewithin.

Reference is now made to FIG. 1 of the drawing illustrating a container of this invention which is designated generally by the reference numeral 20 and the container 20 comprises a deformable metal container body 21 particularly adapted to contain a product therein and a deformable metal closure 22 for the container body. The container 20 may contain any suitable product where thin gauge easily deformable metallic material may be employed with such gauge to be defined in further detail subsequently; however, such container is particularly adapted to contain a food product 23 such as an individual serving of a dessert such as fruit, pudding, gelatin, or the like whereby a typical container 20 may have a 5 ounce capacity.

Figure 2:
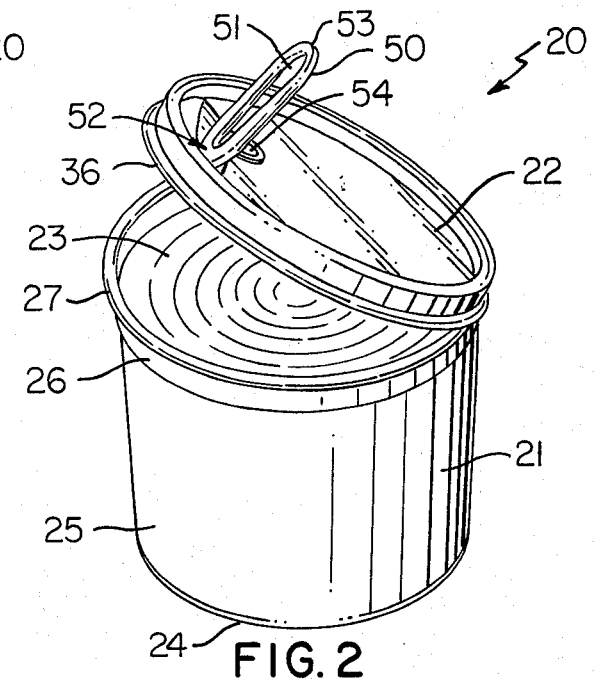
FIG. 2 is a perspective view showing the closure of FIG. 1 practically lifted away from the container body.
Figure 3:
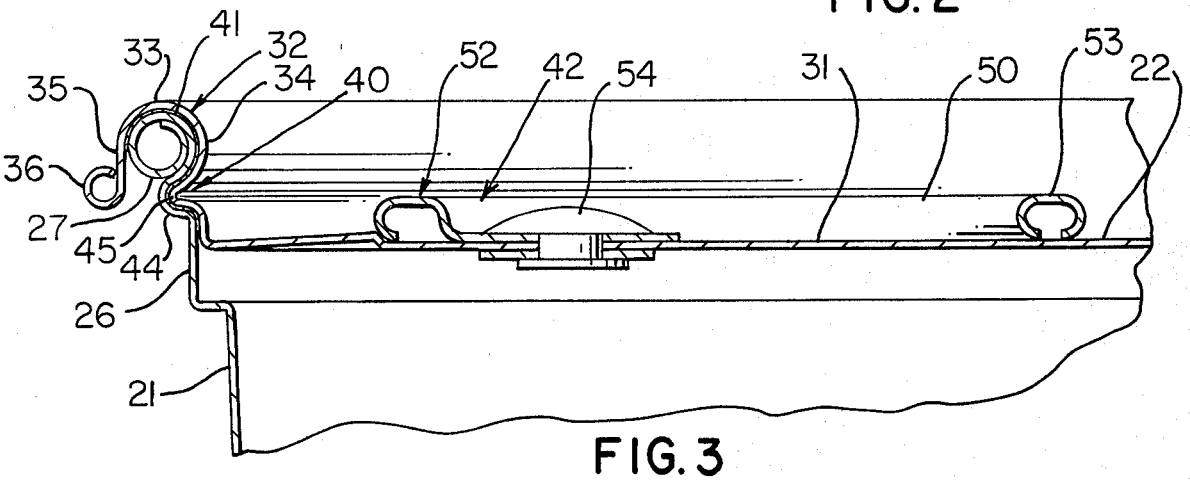
FIG. 3 is an enlarged fragmentary cross-sectional view taken essentially on the line 3—3 of FIG. 1.

As seen in FIGS. 1–3, the container body 21 has a bottom wall 24 and a side wall 25 which has a tubular upper portion 26 which as best seen in FIG. 3 terminates in a first circumferential bead 27. The bead 27 is a substantially tubular toroidal bead extending about the entire periphery of the tubular upper portion 26 and the bead 27 defines an open end for the container body 21.

The deformable closure 22 has a main body portion 31 adjoined at its outer edge by an annular flange which is designated generally by the reference numeral 32 and the flange 32 has a generally U-shaped cross-sectional configuration defined by an uppermost bight 33 with an inner leg portion 34 and an outer leg portion 35 extending downwardly from opposite ends of the bight 33. The inner leg portion 34 of flange 32 adjoins the main body portion 31 and the outer leg portion 35 terminates in a second circumferential bead 36. The bead 36 is also in the form of a substantially tubular toroidal bead.

As seen in FIG. 3, the container 20 has an annular indentation which is designated generally by the reference numeral 40 in the inner leg portion 34 of the flange 32 and in the tubular upper portion 26. The indentation 40 is provided or disposed beneath the bead 27 and such indentation will be described in more detail subsequently. The indentation 40 assures the provision of a seal between the closure 22 and the container body 21 and such seal may include additional seal means 41 to be subsequently described, between the closure and container body or such closure 22 may be installed on the container body without seal means 41.

Figure 4:
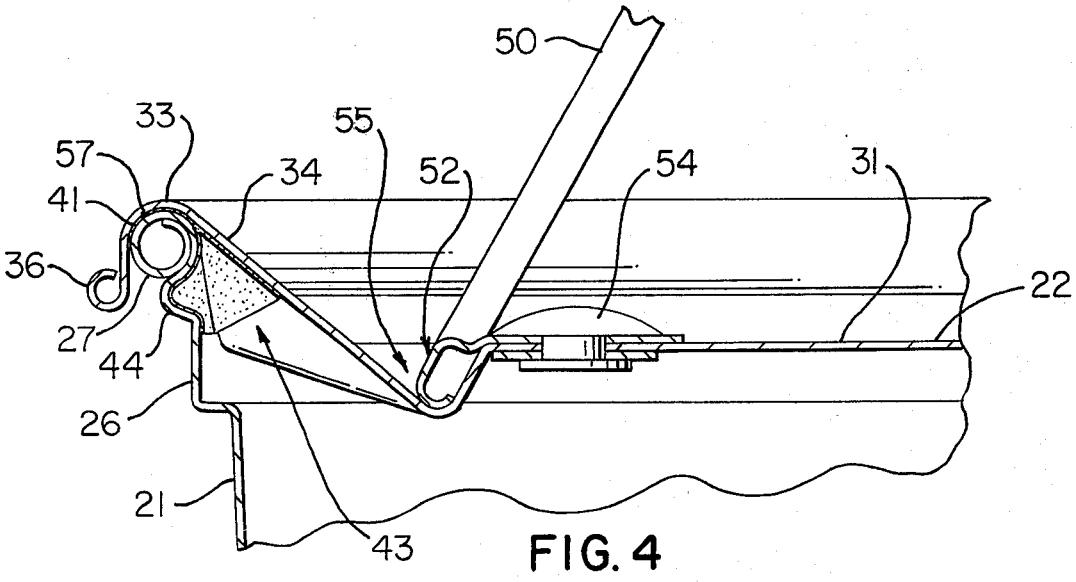
FIG. 4 is a view similar to FIG. 3 showing the pull tab being lifted to deform at least part of the main body portion of the closure and thereby releasing a portion of the flange comprising such closure away from the container body to enable removal of the closure from the container body.

The closure 22 has pull tab force transmitting means designated generally by the reference numeral 42 provided as a part of the closure 22 for permanently deforming at least part of the main body portion 31 within the container 20 and in particular within the container body 21 causing at least part of the inner leg portion 34 of flange 32 to be pulled away from the tubular upper portion 26 and bead 27 and as illustrated at 43 in FIG. 4 enabling removal of the closure 22 simply by lifting upwardly on the closure. The force transmitting means 42 will be described in more detail subsequently.

The annular indentation 40 may be provided utilizing suitable means or technique known in the art. For example, the annular indentation may be formed by the apparatus disclosed in application Ser. No. 534,721. Further, it is to be understood that the indentation may be formed in the bead 27 in the manner disclosed in the said application.

The annular indentation 40 is in the form of an annular groove 44 of generally V-shaped cross-sectional configuration extending in the tubular upper portion 26 and a corresponding generally V-shaped projection 45 is provided on the inner leg portion 34 so that the annular projection 45 extends within the annular groove 44. It will be appreciated that the annular groove 44 is concave inwardly toward the center of the container 20 and thus toward the center of the closure 22 and that the annular projection 45 extends outwardly from leg 34 with its convex portion toward leg 35.

The container 20 has seal means 41 as previously mentioned and such seal means may be in the form of a suitable adhesive compound 41 between the inner leg portion 34 of the flange 32 and the tubular upper portion 26 of the container body 21. The sealing compound 41 may be of the type ordinarily used on a carbonated beverage container or the like and a typical compound which may be used is produced by W. R. Grace and Co., Organic Chemicals, Dewey Almy Chemical Division, Cambridge, Mass. 02140 and sold under the trade designation of Dewey Almy Compound 1108.

As previously mentioned, the container 20 has force transmitting means provided as an integral part of the closure 22 for the purpose previously described. The force transmitting means in this example is in the form of a pull tab 50 or ring tab having a finger receiving opening 51 extending therethrough and the tab 50 has a forward portion 52 and a rear portion 53 and means in the form of a rivet 54 attaching the tab to the main body portion 31 of the closure 22 between the forward portion 52 and rear portion 53 thereof. The tab 50 is adapted to be pivoted about its rivet 54 by grasping with a finger between the rear portion 53 and lifting upwardly against such rear portion 53 thereby causing the forward portion 52 to pivot about the rivet 54 thereby moving the forward portion 52 toward the center of the container body 21 to permanently deform part of the main body 31 as illustrated at 55. This deformation is readily accomplished due to the fact that the closure 22 is made of thin gauge metal material, as previously mentioned, and such deformation causes at least a part of the inner leg portion 34 to be pulled away from the tubular upper portion 26 and the first bead 27 enabling removal of the closure by lifting upwardly on the closure as previously explained. It will also be appreciated that movement of the forward portion 52 of the tab against the main body portion causing permanent deformation thereof as illustrated at 55 in FIG. 4 which also causes a shearing of the seal means or adhesive compound 41 upon pulling of the inner leg portion 34 away from the tubular upper portion 26 and as illustrated at 43. The inward urging and thus permanent deformation of at least part of the main body portion 31 within the container body 21 also causes one or more wrinkles or creases in the flange 32. Such wrinkles or creases have not been shown. However, each wrinkle or crease in the U-shaped flange 32 often produce a corresponding opening between the closure 22 and body 21 as shown at 57 in FIG. 4 which allows releif of the partial vacuum which is preferably produced within the container 20 upon packaging food products such as 23 therewithin. The release of the partial vacuum coupled with the shearing of a substantial amount of the adhesive compound 41 enables the closure 22 to be removed by continuing to pull upwardly on the ring tab 50 after lifting thereof to the substantially vertical position from the plane of wall portion 31.

The side wall 25 of the container body 21 is substantially frustoconical and the tubular upper portion 26 is offset radially outwardly a limited vertical height. Preferably the tubular upper portion is also substantially frustoconical and the upper portion 26 is interconnected to the top edge of the main part of the side wall 25 by a substantially horizontally extending radial flange. With this construction and arrangement the container body 21 is nestable and may be processed by automatic handling equipment.

Any suitable material may be used to make the container of this invention; however, the container body and closure are preferably made of a thin gauge metal material as mentioned previously and preferably in the form of aluminum alloys. For example, for a five ounce container used to contain desserts, or the like, the closure may be made of 3003 H-14 or 5005 H-14 aluminum alloy 0.006 inch thick. The container body may be made of 5050 H-19 or 3003 H-19 aluminum alloy 0.0075 inch thick.

In this disclosure of the invention the container body and closure in each instance is shown as having a generally circular peripheral outline. However, it is to be understood that the concept of this invention is fully applicable to containers having container bodies and closures of cooperating non-circular peripheral outlines such as oblong, rectangular, and the like.

The container body and closure of the container 20 of this invention is preferably coated on its inside and outside surfaces with a suitable protective coating which may be modified vinyl base coating such as modified polyvinyl chloride film. For example, in one application of this invention where five ounce containers were used to contain desserts a polyvinyl chloride film coating of 8.5 milligram per square inch was provided on the inside surface of the container body and closure and a 2 milligram per square inch coating was provided on the outside surface of these components. It will also be appreciated that the coating on the inside and outside surfaces may be any suitable thermoset coating, or the like.

While present embodiments of this invention, and methods of practicing the same, have been illustrated and described, it will be recognized that this invention may be otherwise variously embodied and practiced within the scope of the following claims.

What is claimed is:

1. A container comprising, a deformable metal container body adapted to contain a product therein and having a bottom wall and a side wall which has a tubular upper portion terminating in a first circumferential bead defining an open end in said container body, a deformable metal closure for said container body, said closure having a main body portion adjoined at its outer edge by an annular flange, said flange having a generally U-shaped cross-sectional configuration defined by a bight with an inner leg portion and an outer leg portion extending from opposite ends of said bight, said inner leg portion adjoining said main body portion and said outer leg portion terminating in a second circumferential bead, an annular indentation in said inner leg portion of said flange and said tubular upper portion beneath said first bead, said annular indentation providing a seal between said closure and container body, and force transmitting means provided as a part of said closure for permanently deforming at least part of said main body portion within said container body and causing at least a portion of said inner leg portion to be pulled away from said tubular upper portion and first bead thereby enabling removal of said closure by lifting upwardly on said closure.

2. A container as set forth in claim 1 in which said annular indentation is in the form of a groove of generally V-shaped cross-sectional configuration extending in to said tubular upper portion and a corresponding V-shaped projection on said inner leg portion extending within said groove.

3. A container as set forth in claim 2 and further comprising seal means between said inner leg portion and said tubular upper portion and first bead.

4. A container as set forth in claim 3 in which said force transmitting means causes shearing of said seal means upon pulling of said part of said inner leg portion away from said tubular upper portion.

5. A container as set forth in claim 4 in which said force transmitting means comprises a tab having a forward portion and a rear portion, and means attaching said tab to said main body portion between said forward and rear portions, said tab being adapted to be pivoted about said attaching means by grasping and lifting upwardly on said rear portion causing said forward portion to permanently deform said part of said main body.

6. A container as set forth in claim 5 in which said attaching means comprises a rivet.

7. A container as set forth in claim 5 in which said seal means is an adhesive composition.

8. A container as set forth in claim 5 in which said tab is a ring tab having a finger-receiving opening therethrough.

9. A container as set forth in claim 2 in which said tubular upper portion is offset outwardly from the remainder of said side wall and said remainder is substantially frustoconical.

10. A container as set forth in claim 9 in which each of said first and second beads is a substantially tubular toroidal bead and both said container body and closure are made of aluminous materials.

* * * * *